United States Patent [19]

Huang

[11] Patent Number: 4,813,191

[45] Date of Patent: Mar. 21, 1989

[54] MODULAR SPACE FRAMED EARTHQUAKE RESISTANT STRUCTURE

[76] Inventor: Yen T. Huang, P.O. Box 31596, Dallas, Tex. 75231

[21] Appl. No.: 124,832

[22] Filed: Nov. 24, 1987

[51] Int. Cl.[4] ..... E02D 27/34; E04H 12/00

[52] U.S. Cl. ..... 52/167; 52/637; 52/646; 405/204; 405/209; 405/195; 403/171

[58] Field of Search ..... 52/637, 638, 646; 405/204, 209, 195; 403/171, 176, 300

[56] References Cited

U.S. PATENT DOCUMENTS

| | | | |
|---|---|---|---|
| 3,965,626 | 6/1976 | Johnson | 52/DIG. 10 |
| 3,995,897 | 12/1976 | Paskert | 403/300 |
| 4,018,057 | 4/1977 | Erzen | 405/205 |
| 4,288,947 | 9/1981 | Huang | 52/81 |
| 4,645,379 | 2/1987 | Grimsley | 52/DIG. 10 |
| 4,648,223 | 3/1987 | Richard | 403/171 |

*Primary Examiner*—Henry E. Raduazo
*Attorney, Agent, or Firm*—W. Kirk McCord

[57] ABSTRACT

A modular spaced framed structure is constructed using uniform components to provide the desired geometry of the modular structure. The structure is comprised of a plurality of rigid Y-shaped devices, each of which has three tubular branches which are disposed at respective predetermined space angles with respect to one another, and a plurality of panels spanning the spaces between the devices. Linear coupling members are also provided for interconnecting abutting branches of adjacent devices. In the preferred embodiment the three branches of each device are oriented at respective space angles of 108°, 108° and 108° so that a tower structure having a pentagonal horizontal cross-section is formed. Each successive level of the tower below the apex has a substantially greater area than the level above it so that the legs of the tower are inclined to provide greater resistance to earthquake forces. This type of structure is particularly well-suited for supporting offshore platforms and can be efficiently assembled on site due to the modular nature of the construction. The structure can be reinforced by inserting cables into the tubular branches to prestress the connections and pouring a filler material such as concrete into the branches to enhance the rigidity of the tower structure.

8 Claims, 5 Drawing Sheets

MODULAR SPACE FRAMED EARTHQUAKE RESISTANT STRUCTURE

FIELD OF THE INVENTION

The present invention relates generally to modular space framed structures and in particular to a modular space framed support structure for enhancing the earthquake resistance of the construction being supported.

BACKGROUND OF THE INVENTION

Constructions, such as buildings, offshore platforms and the like, typically include a substructure, such as a foundation, support beams or the like, to support the superstructure of the construction. In building construction structural frames can support loadings acting in unison with the foundation system. In the case of an offshore platform, the support structure, which is typically comprised of vertical support members embedded in the ocean bottom, is substantially completely disposed below the ocean surface for supporting the platform superstructure above the water level.

DESCRIPTION OF THE PRIOR ART

According to prior practice the support structure for an offshore platform is typically comprised of vertical support members (e.g., "jack up" platform) which are embedded at one end at respective first ends thereof in the ocean bottom with concrete anchoring blocks or the like and respective second ends which are in contact with the platform superstructure to maintain the superstructure above the water line. Laterally extending cross-members are typically used to provide structural rigidity for the support structure. The support structure typically has a rectangular cross-section so that the width of the support structure is substantially the same from top to bottom along the support structure.

One problem associated with such rectangular support structures is that the stability of the support structures diminishes as a function of the vertical depth thereof for a given width of the support structure. The stability problem is particularly significant if the offshore platform is located in an area of high earthquake probability. The horizontal movement of the seabed caused by an earthquake will produce an overturning moment on the platform. The magnitude of the overturning moment is directly proportional to the force of the earthquake and the height of the platform above the seabed (i.e., the depth of the water) and is indirectly proportional to the horizontal width or diameter, as the case may be, of the support structure. In deep water, the width of the support structure must be substantially increased, which not only complicates the construction process, but also substantially increases the cost thereof.

OBJECTS OF THE INVENTION

It is, therefore, the principal object of the present invention to provide an improved building structure. It is another object of the invention to enhance the resistance of the support structure to earthquake forces.

It is still another object of the invention to provide a modular support structure which can be constructed by interconnecting uniform structural components.

It is still another object of the invention to provide a modular support structure using relatively lightweight uniform components which can be structurally reinforced on site.

It is a further object of the invention to provide uniform structural components, which can be manufactured in a factory with rigid quality control of each component, thereby reducing the amount of work necessary in the field.

It is still a further object of the invention to reduce the time and cost of constructing building structures.

SUMMARY OF THE INVENTION

These and other objects are accomplished in accordance with the present invention wherein a modular construction device is comprised of first, second and third tubular members of equal length, which are interconnected to define a rigid Y-shape with respective obtuse space angles between each pair of tubular members. The first and second tubular members are oriented to define respective portions of respective first and second horizontal frame members at a particular level in a multi-level space framed structure. The third tubular member is oriented at an acute angle with respect to a vertical axis which is perpendicular to a horizontal plane defined by that particular level so that the third tubular member defines an inclined leg of the structure inter-connecting the particular level with an adjacent level.

In one embodiment the device includes a first sleeve member extending beyond the intersection of the first, second and third tubular members. The major axis of the first sleeve member is substantially aligned with the major axis of the third tubular member for receiving the corresponding third tubular member of another one of the devices to define an inclined leg of the structure when multiple devices are interconnected to form the multi-level structure. In the preferred embodiment the device further includes a second sleeve member for receiving respective facing ends of the first tubular member of a first construction device and the second tubular member of a second construction device to define a horizontal frame at a particular level in the structure. Locking means is provided for retaining the corresponding third tubular member within the first sleeve member and the corresponding first and second tubular members within the corresponding second sleeve member.

In another aspect of the invention a plurality of discrete sets of modular construction devices are used to form a modular structure having a plurality of horizontal space framed levels. The first and second tubular members of the construction devices of each set are interconnected to define a polygonal frame at a corresponding level of the structure and aligned ones of the third tubular members are interconnected at successive levels in the structure to define the inclined legs of the structure. The uppermost polygonal frame has the smallest area among the polygonal frames and each successively lower frame has a correspondingly greater area to enhance the stability of the structure. In the preferred embodiment each polygonal frame is comprised of a plurality of horizontal legs of equal length and the length of each tubular member of the construction devices in a particular set is equal to one-half the length of one leg of the corresponding polygonal frame defined by that particular set of construction devices.

BRIEF DESCRIPTION OF THE DRAWINGS

Further objects and advantages of the invention will be apparent from the detailed description and claims when read in conjunction with the accompanying drawings wherein:

DETAILED DESCRIPTION OF THE PREFERRED EMBODIMENT

In the description which follows, like parts are marked throughout the specification and drawings, respectively. The drawings are not necessarily to scale and in some instance proportions have been exaggerated in order to more clearly depict certain features of the invention.

Figure 1:
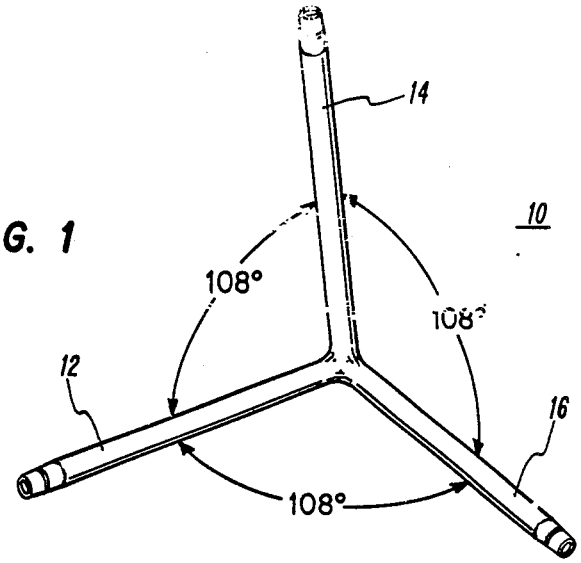
FIG. 1 is a perspective view of a modular construction device according to the present invention.

Referring to FIG. 1, a modular construction device 10 is comprised of first, second and third tubular branches 12, 14 and 16 of equal length, which are interconnected to define a rigid Y-shape with respective obtuse space angles between each pair of tubular branches. In the embodiment illustrated in FIG. 1, the three space angles are each 108°.

Figure 3:
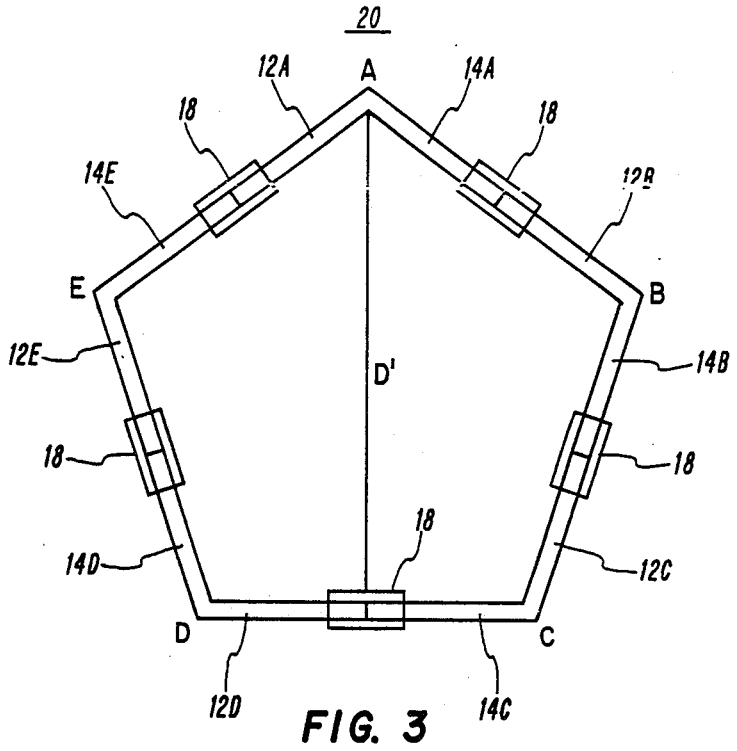
FIG. 3 is a top plan view of a particular level in the modular space framed structure.
Figure 4A:
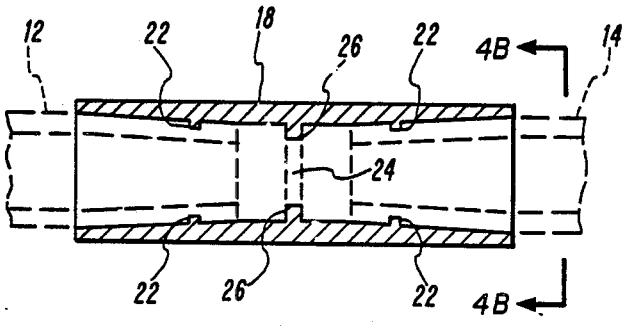
FIGS. 4A and 4B are respective sectional and end views of a sleeve member used to interconnect aligned tubular members at a particular level in the modular space framed structure.

Referring also to FIG. 3, a plurality of construction devices 10 are interconnected by a corresponding plurality of sleeve members 18 to define a pentagonal-shaped horizontal frame 20. In FIG. 3, five construction devices 10 are disposed at the respective five corners A, B, C, D, and E of pentagonal frame 20 so that the corresponding third tubular branch 16 of each device 10 depends outwardly and downwardly from the plane defined by frame 20 and the corresponding first and second tubular branches 12 and 14 are interconnected to define members of frame 20. For example, first tubular branch 12E of the particular device 10 disposed at corner E of frame 20 is aligned with the corresponding second tubular branch 140 of the particular device 10 which is disposed at corner D of frame 20. Each sleeve member 18 has a central bore extending therethrough for receiving respective facing ends of each pair of aligned tubular branches, as best illustrated in FIG. 4A. Each sleeve member 18 connects the corresponding first tubular branch 12 of one device 10 with the corresponding second tubular branch 14 of an adjacent device 10 to define pentagonal frame 20. Each member of frame 20 has a length approximately twice that of the length of each tubular branch.

Figure 4B:
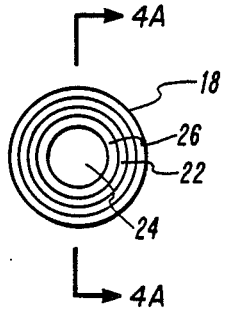

Referring also to FIGS. 4A and 4B, the ends of each tubular branch 12 and 14 are tapered for being received within the central bore of the corresponding sleeve member 18. Disposed adjacent to the end of each tubular branch 12, 14 is a groove which extends circumferentially around the corresponding tubular branch 12, 14 for engaging a corresponding male notch 22 in the bore of sleeve member 18 for locking the corresponding tubular branches 12, 14 in respective predetermined fixed positions within sleeve member 18. A central hole 24 is left open to accomodate the passage of pre-stressing wire cables. A rigid diaphragm 26 of sleeve member 18 is sandwiched between the respective facing ends of aligned first and second tubular branches 12 and 14. The locking engagement between the corresponding female groove and male notch 22 is described in greater detail in U.S. Pat. No. 4,288,947, which is incorporated herein by reference.

Figure 5:
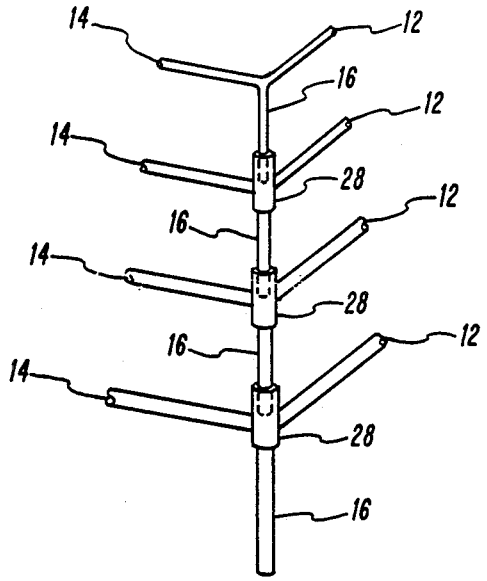
FIG. 5 is a perspective view of the interconnection of the corresponding tubular members at successive levels to define the vertical legs of the structure in accordance with the present invention.
Figure 6:
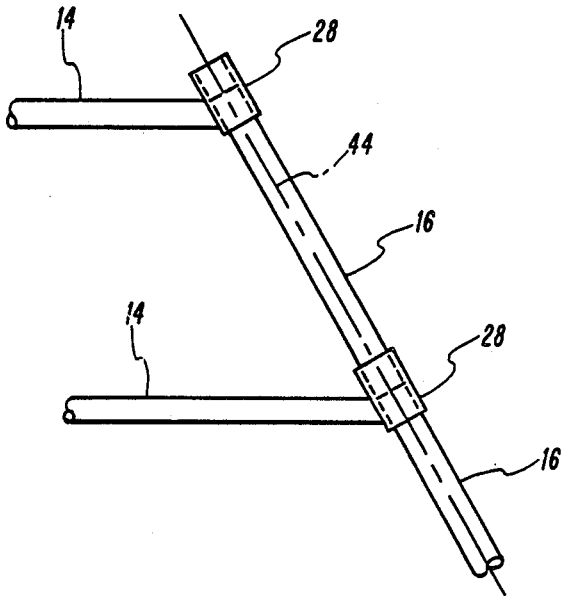
FIG. 6 is an elevational view illustrating the interconnection of the corresponding tubular members at successive levels to define the vertical legs of the structure in accordance with the present invention.

Referring to FIGS. 5 and 6, the corresponding third tubular branches 16 are interconnected by means of a corresponding plurality of sleeve members 28 to define a substantially vertical leg. Each sleeve member 28 is preferably integrally formed on a corresponding construction device 10 so that a portion of each sleeve member 28 extends beyond the intersection of first, second and third tubular branches 12, 14 and 16 of the corresponding device 10, as best shown in FIG. 6.

Figure 7A:
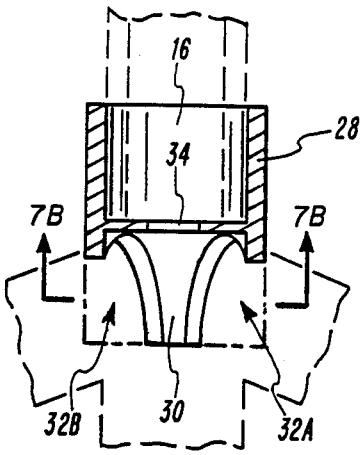
FIGS. 7A and 7B are respective sectional and end views of a sleeve member used to interconnect the corresponding tubular members at successive levels in the structure to define the vertical legs of the structure in accordance with the present invention.
Figure 7B:
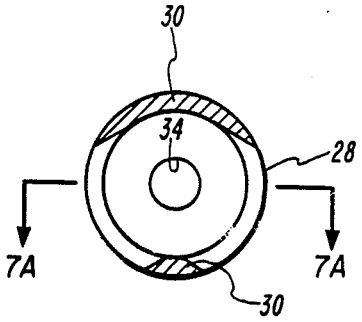

Referring to FIGS 7A and 7B, sleeve member 28 includes a centrally disposed flexible saddle 30, which defines two chambers 32A and 32B within sleeve member 28 for receiving the corresponding first and second tubular branches 12 and 14 within sleeve member 28. Sleeve member 28 further includes a central diaphragm 34 for being sandwiched between the corresponding third tubular branch 16 of an adjacent construction device 10 and saddle 30. The locking engagement described above with reference to FIGS. 4A and 4B is also used to receive third tubular branch 16 within the corresponding sleeve member 28.

Figure 2:
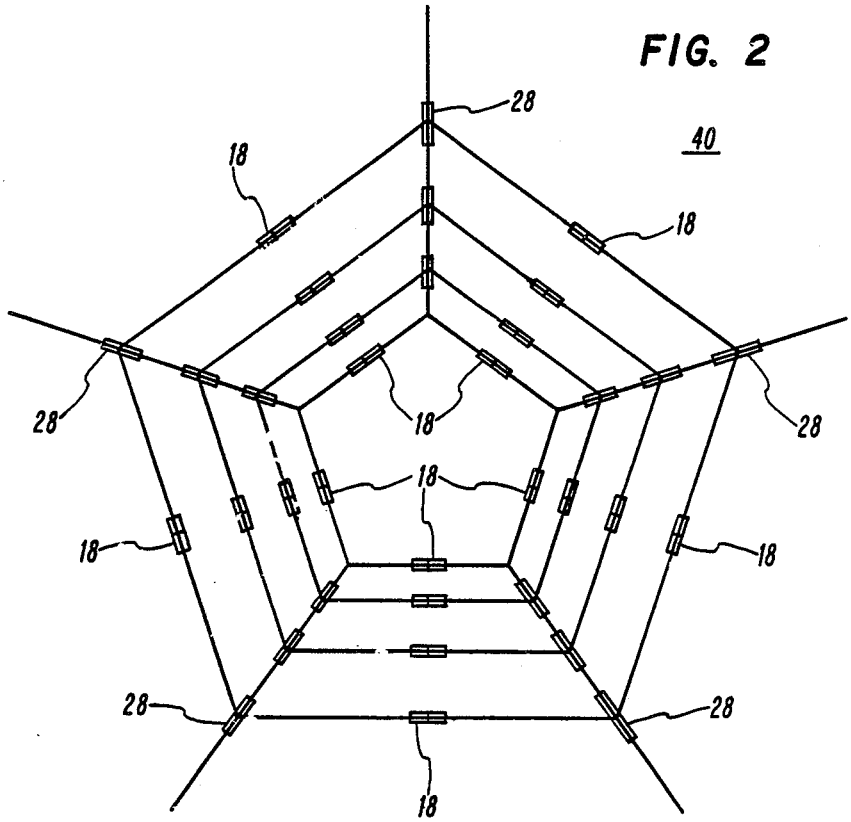
FIG. 2 is a top plan view of a modular space framed structure according to the present invention.
Figure 8:
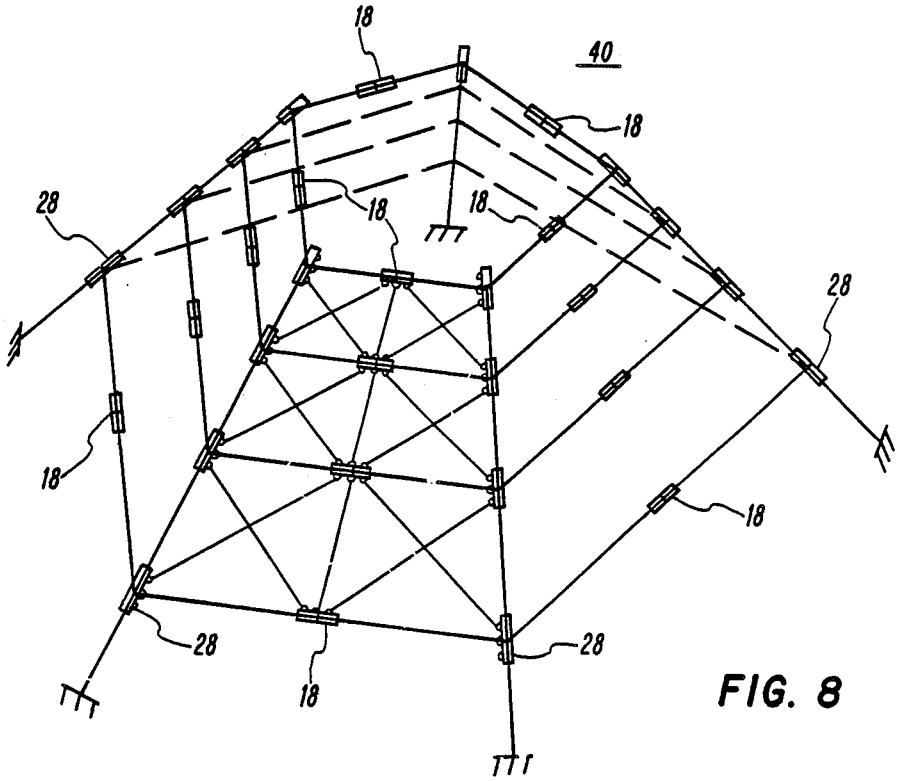
FIG. 8 is a perspective view of a modular space framed structure in accordance with the present invention.

Referring to FIGS. 2 and 8, a modular space framed structure 40 in the shape of a truncated pyramid is formed by interconnecting a plurality of construction devices 10. Construction devices 10 are divided into N number of discrete sets of construction devices 10 corresponding to N number of levels in structure 40. In FIGS. 2 and 8, structure 40 is shown with four levels, with each level being comprised of a discrete pentagonal frame 20. The vertical legs of structure 40 are inclined at a predetermined acute angle with respect to respective vertical axes which are perpendicular to the respective horizontal planes defined by the respective pentagonal frames to enhance the stability and earthquake resistance of structure 40. The pentagonal frame at the uppermost level of structure 40 has the smallest area among the frames and each successively lower pentagonal frame has a corresponding greater area. The inclined legs are defined by the interconnection of aligned third tubular branches 16 at each successive level in structure 40.

Tubular branches 12, 14 and 16 of each device 10 in each discrete set have substantially the same length. For example, if the length of each tubular branch 12, 14 and 16 in the uppermost level is L, the length of each tubular branch 12, 14 and 16 at each level in structure 40 is equal to approximately $1.309^{(N-1)} \times L$, where N is an integer representing the particular level in structure 40 counting in succession from the uppermost level to the lowermost level of structure 40. Therefore, the length of each tubular branch 12, 14 and 16 increases by approximately 30.9% between each successive level in structure 40 from the top to the bottom thereof. Similarly, the diameter D' (which is measured as shown in FIG. 3) increases by approximately 30.9% between each successive level from top to bottom in structure 40. It can be determined mathematically that the diameter D' of each pentagonal frame is equal to approximately 3.0777 multiplied times the length of each tubular branch 12, 14 and 16 (i.e., $3.0777 \times 1.309^{(N-1)} \times L$) at that particular level in structure 40. Thus the diameter D' of the lowermost level (i.e. N=4) in structure 40 is approximately 6.9031 L as compared to the diameter D' of the uppermost level (i.e., N=1) of structure 40, which is approximately 3.0777 L.

Structure 40 can be reinforced by applying bracing members between pentagonal frames, particularly in areas where seismic, ice, current, wave and wind forces acting on the structure become critical. Panels may also be used to span the spaces between the pentagonal frames. The tubular branches and sleeve members have central openings for receiving pre-stressing cables 44 therethrough, as shown in FIG. 6, to achieve structural rigidity. A filler material, such as concrete, can be poured into the tubular branches to further reinforce the structure.

Figure 9:
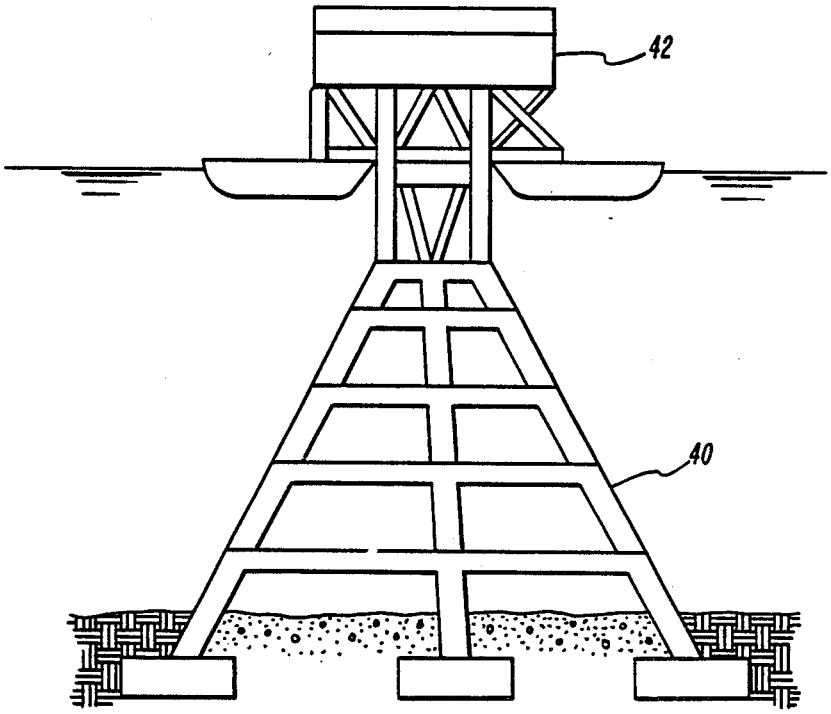
FIG. 9 is an elevational view of an earthquake resistant structure for supporting an offshore platform in accordance with the present invention.

The modular space framed structure 40 according to the present invention is particularly well-suited for marine operations where support structures must be built under adverse conditions. Referring to FIG. 9, structure 40 can be used as a submerged structure to support a work platform superstructure 42. Structure 40 can be assembled on shore and transported to the installation site or alternatively structure 40 can be assembled on site using modular devices 10.

The earthquake resistance force of a structure can be expressed as Ph/Db, where P is the lateral force exerted on the structure by the earthquake, h is the height of the structure and Db is the diameter of the base level of the structure. The natural pyramidal shape of the structure according to the present invention lowers the center of gravity of the structure and substantially reduces the required earthquake resistance force of the structure by increasing the diameter oi the base level thereof. For example, a substantially rectangular structure having the same diameter from top to bottom of approximately 3.0777 L will require an earthquake resistance force of approximately Ph/3.0777L. On the other hand, a pyramidal structure according to the present invention having seven levels with the same diameter D' at the uppermost level as the aforementioned rectangular structure will require an earthquake resistance force of approximately Ph/15.4833L. Thus, the earthquake resistance force is approximately one-fifth of the conventional rectangular structure with substantially the sam diameter D' at the top level in the structure.

The pentagonal frames comprising each level of the structure provide an optimum balance between the horizontal force resistive capability of a circular frame structure and the ease of construction of a rectangular frame structure. Another advantage of the modular space frame structure according to the present invention is the rigidity of the corners at each level in the structure provided by rigid modular construction devices. The aligned branches of the modular construction devices can be quickly and conveniently interconnected as compared to conventional pin or bolt connections. The construction devices can be manufactured to uniform specifications in a factory with rigid quality control, thereby reducing the amount of work necessary in the field.

Various embodiments of the invention have been described in detail. Since it is obvious that many changes in and additions to the above-described preferred embodiment may be made without departing from the nature, spirit and scope of the invention, the invention is not to be limited to said details except as set forth in the appended claims.

What is claimed is:

1. A modular structure having plurality of horizontal space framed levels, comprising:

a plurality of discrete sets of modular construction devices corresponding to the number of levels in the structure, the construction devices of each discrete set each having first, second and third tubular members of substantially equal length and interconnected to define a rigid Y-shape with respective obtuse space angles between each pair of tubular members;

first connector means for interconnecting the corresponding first and second tubular members of the construction devices of each discrete set so that the first and second tubular members of the construction devices of each discrete set define a polygonal frame at a corresponding level of the structure; and second connector means for interconnecting the aligned ones of the third tubular members at successive levels in the structure, said third tubular members being oriented at a predetermined acute angle with respect to respective vertical axes which are perpendicular to the corresponding polygonal frames so that the interconnection of the aligned third tubular members defines corresponding inclined legs of the structure, the uppermost polygonal frame having the smallest area among the polygonal frames and each successively lower polygonal frame having a correspondingly greater area to enhance the stability of the structure.

2. The structure according to claim 1 wherein each polygonal frame is comprised of a plurality of horizontal legs of equal length and the length of each tubular member of the construction devices in a particular set is equal to one-half the length of one leg of the corresponding polygonal frame defined by that particular set of construction devices.

3. The structure according to claim 2 wherein the first connector means is comprised of a plurality of first sleeve members, each of which has a central bore for receiving respective ends of the first tubular member of a first construction device and the second tubular member of a second construction device adjacent to the first construction device, to interconnect the corresponding first and second tubular members of the first and second devices to define one leg of the corresponding polygonal frame.

4. The structure according to claim 3 wherein said second connecting means is comprised of a plurality of second sleeve members, each of which has a central bore for receiving the facing ends of an aligned pair of third tubular members to define the inclined legs of the structure.

5. The structure according to claim 4 wherein each of said second sleeve members is integrally formed on a corresponding one of said construction devices so that said second sleeve member extends beyond the intersection of the corresponding first, second and third tubular members of the corresponding device, the major axis of the second sleeve member being substantially aligned with the major axis of the corresponding third tubular member for receiving the third tubular member of an adjacent construction device which is in alignment with the corresponding third tubular member.

6. A modular structure having N-number oi horizontal space framed levels, where N is an integer, comprising:

N-number of discrete sets of construction devices, the construction devices of each discrete set each having first, second and third tubular members of substantially equal lengths which are interconnected to form a rigid Y-shape with respective space angles of 108°, 108° and 108° between each pair of tubular members, all of the construction devices in the same discrete set being disposed at the same level in the structure;

first connector means for interconnecting the corresponding first and second tubular members of the construction devices at the corresponding level to define a corresponding pentagonal horizontal frame at each level, the respective intersections of the first and second tubular members oi each construction device defining the respective corners oi the corresponding pentagonal frame; and second connector means for interconnecting aligned ones of the third tubular members at successive levels in the structure, said third tubular members being oriented at a predetermined acute angle with respect to respective vertical axes which are perpendicular to the respective horizontal planes defined by the respective pentagonal frames so that the interconnection of the aligned third tubular members defines respective inclined legs of the structure.

7. The structure according to claim 6 wherein the length oi each tubular member oi the construction devices of a particular discrete set is equal to approximately $1.309^{(N-1)} \times L$, where L is a predetermined reference length and N is an integer representing the particular level in the structure at which the particular discrete set is disposed, counting in succession from the uppermost level to the lowermost level of the structure.

8. The structure according to claim 7 wherein a pentagonal frame at an uppermost level in the structure has the smallest area among the pentagonal frames of the structure and each successively lower pentagonal frame has a correspondingly greater area to enhance the stability of the structure.

* * * * *